US010151569B2

(12) United States Patent
Glenn et al.

(10) Patent No.: US 10,151,569 B2
(45) Date of Patent: Dec. 11, 2018

(54) INITIATOR HAVING AN EXPLOSIVE SUBSTANCE OF A SECONDARY EXPLOSIVE

(71) Applicant: Halliburton Energy Services, Inc., Houston, TX (US)

(72) Inventors: Corbin S. Glenn, Burleson, TX (US); Thomas Jeffrey Wuensche, Granbury, TX (US); Justine Marie Davidson, Burleson, TX (US); James Marshall Barker, Mansfield, TX (US); David John Leidel, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/765,553

(22) PCT Filed: Feb. 5, 2013

(86) PCT No.: PCT/US2013/024753

§ 371 (c)(1),
(2) Date: Aug. 3, 2015

(87) PCT Pub. No.: WO2014/123508

PCT Pub. Date: Aug. 14, 2014

(65) Prior Publication Data

US 2016/0003600 A1 Jan. 7, 2016

(51) Int. Cl.

| | |
|---|---|
| ***F42C 19/08*** | (2006.01) |
| ***F42B 3/10*** | (2006.01) |
| ***E21B 43/1185*** | (2006.01) |

(52) U.S. Cl.

CPC ..... *F42C 19/08* (2013.01); *E21B 43/1185* (2013.01); *F42B 3/10* (2013.01)

(58) Field of Classification Search

CPC ..... C06C 7/00; F42C 19/08; F42C 19/0803; F42C 19/12; F42B 3/10; E21B 43/1185

See application file for complete search history.

(56) References Cited

U.S. PATENT DOCUMENTS 4,564,405 A * 1/1986 Pallanck ..... C06B 45/02 149/111
4,616,566 A * 10/1986 Yates, Jr. ..... C06C 7/00 102/275.4

(Continued)

FOREIGN PATENT DOCUMENTS

EP 0675262 A1 * 10/1995 ..... E21B 43/1185
EP 0675262 A1 10/1995

(Continued)

OTHER PUBLICATIONS

International Search Report dated Nov. 6, 2013; PCT International Application No. PCT/US2013/024753.

*Primary Examiner* — Stephen Johnson
*Assistant Examiner* — Joshua T Semick
(74) *Attorney, Agent, or Firm* — McGuireWoods LLP

(57) ABSTRACT

An initiator comprises: a first explosive substance, wherein the first explosive substance comprises a secondary explosive, and wherein at least the first explosive substance is capable of being initiated. The initiator comprises effectively no primary explosive. The secondary explosive can be a thermally-stable secondary explosive. A method of using an initiator comprises: initiating the initiator.

20 Claims, 2 Drawing Sheets

(56) References Cited

U.S. PATENT DOCUMENTS

| | | | | | |
|---|---|---|---|---|---|
| 4,632,034 | A * | 12/1986 | Colle, Jr. | E21B 43/116 | 102/275.11 |
| 4,762,067 | A * | 8/1988 | Barker | E21B 43/1185 | 102/202.14 |
| 4,998,477 | A * | 3/1991 | Barker | F42D 1/043 | 102/202.5 |
| 5,046,567 | A * | 9/1991 | Aitken | E21B 43/117 | 102/200 |
| 8,161,880 | B2 * | 4/2012 | Wuensche | F42B 3/10 | 102/275.1 |
| 8,544,563 | B2 * | 10/2013 | Bourne | F42B 1/032 | 166/297 |
| 2011/0283872 | A1 | 11/2011 | Brooks | | |
| 2012/0168226 | A1 | 7/2012 | Brooks | | |

FOREIGN PATENT DOCUMENTS

| | | | | | |
|---|---|---|---|---|---|
| WO | WO-00/26603 | A1 | 5/2000 | | |
| WO | WO 0026603 | A1 * | 5/2000 | C06C 7/00 | |
| WO | WO-0026603 | A1 * | 5/2000 | C06C 7/00 | |
| WO | WO-2012/011995 | A2 | 1/2012 | | |

* cited by examiner

INITIATOR HAVING AN EXPLOSIVE SUBSTANCE OF A SECONDARY EXPLOSIVE

TECHNICAL FIELD

An initiator and methods of use are provided. The initiator includes at least one explosive substance comprising a secondary explosive. The initiator does not include a primary explosive. The explosive substance can also include a sensitizer for increasing the capability of initiation of the explosive substance. The initiator can be used to detonate a charge. The charge can be located in an oil or gas well.

SUMMARY

According to an embodiment, an initiator comprises: a first explosive substance, wherein the first explosive substance comprises a secondary explosive, wherein at least the first explosive substance is capable of being initiated, and wherein the explosive substances of the initiator contain effectively no primary explosive.

According to another embodiment, an initiator comprises: a first explosive substance, wherein the first explosive substance comprises a secondary explosive, wherein at least the first explosive substance is capable of being initiated, and wherein the initiator comprises effectively no primary explosive.

According to another embodiment, a method of using an initiator comprises: initiating an initiator, wherein the initiator comprises: a first explosive substance, wherein the first explosive substance comprises a secondary explosive, wherein at least the first explosive substance is capable of being initiated, and wherein the explosive substances of the initiator contain effectively no primary explosive.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
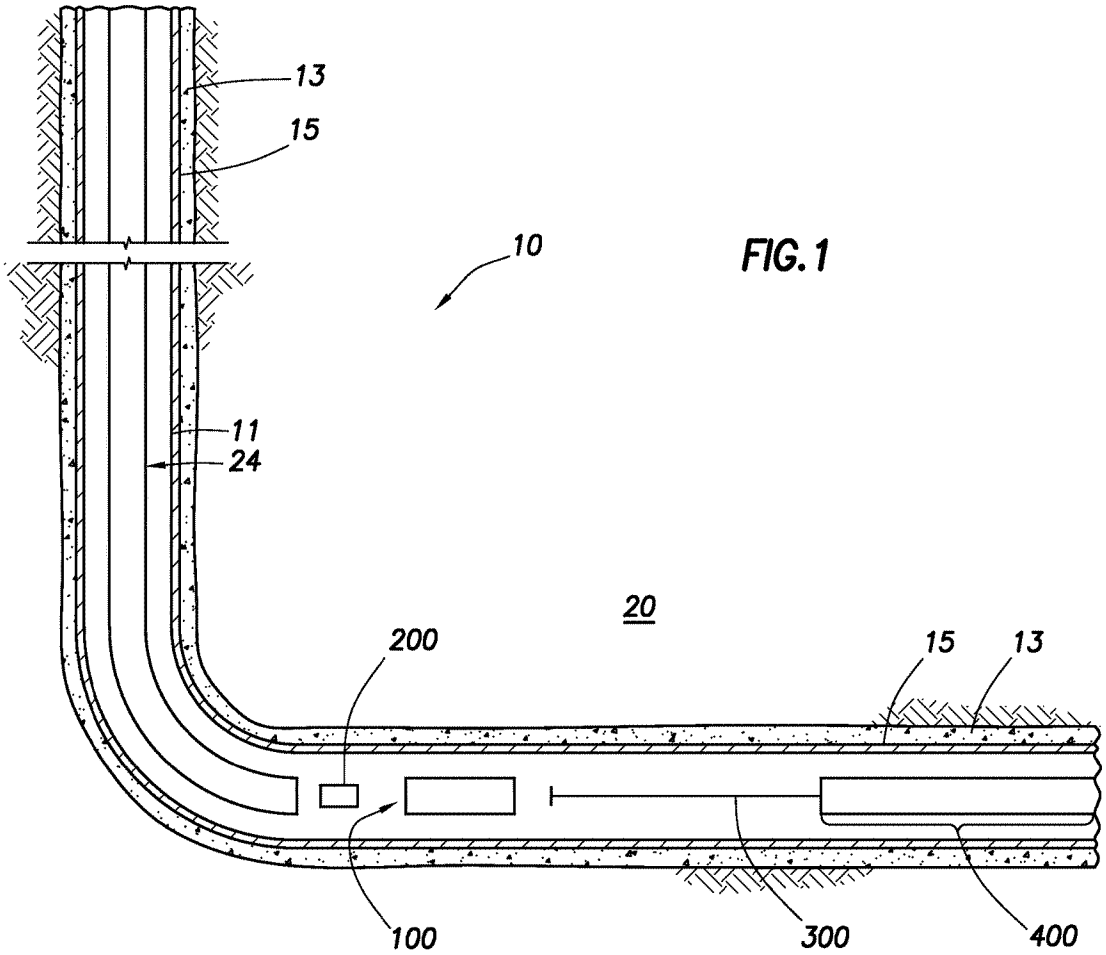
FIG. 1 depicts a wellbore including an initiator.

As used herein, the words "comprise," "have," "include," and all grammatical variations thereof are each intended to have an open, non-limiting meaning that does not exclude additional elements or steps.

As used herein, the term "substance" means elements, molecules, or mixtures having a definite composition and properties. A substance is intended to include, for example, pure elements, metal alloys, metals, polymers, molecules, mixtures, and combinations thereof. No molecule, mixture, or other material is intended to be excluded by the use of the word "substance." As used herein, the phrase "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

Explosive substances are widely used in the construction industry, mining industry, military applications, demolition, and oil and gas industry.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Stimulation techniques can be used to help increase or restore oil, gas, or water production of a well. One example of a stimulation technique is creating a perforation tunnel within a well by using shaped charges. The shaped charges can be detonated, thereby creating a communication path that extends into the formation. The communication path is called a perforation tunnel. The perforation tunnel permits the flow of fluids into or from the formation. The perforation tunnel may also allow fracturing fluids to access the formation.

Perforation tunnels are often created with the use of shaped charges. A shaped charge generally includes a conically-shaped charge case, a solid explosive load, a liner, a central booster, array of boosters, or detonation wave guide, and a hollow cavity forming the shaped charge. If the shaped charge includes a liner, then the liner forms a jet when the explosive load is detonated. Upon initiation, a spherical wave propagates outward from the point of initiation for the basic scenario of a single point initiated charge, initiated along the axis of symmetry.

Shaped charges are generally positioned in the wellbore and can be included in a perforating gun. The perforating gun can be used to hold the charges. The perforating gun may be placed inside a casing and is lowered into the well on either a tubing string or a wireline until it is at the desired location within the well. The perforating gun assembly generally includes a charge holder that holds the shaped charges, a detonation cord that links each charge located in the charge holder, and a carrier. An initiator can be positioned adjacent to one end of the detonation cord. Generally, the activation of the initiator causes an explosion, the explosion ignites the detonation cord, which in turn ignites the shaped charges. When the charges are detonated, particles are expelled, forming a high-velocity jet that creates a pressure wave that exerts pressure on the formation and possibly the casing for a cased-hole portion. The detonation creates the perforation tunnel by high impact pressure from the jet that forces material radially away from the jet axis.

As used herein, the term "initiate," and all grammatical variations thereof, means to begin a chemical reaction that causes the deflagration or detonation of an explosive substance. As used herein, the term "initiator" means a device that is capable of initiating an explosive substance. As used herein, the term "deflagrate," and all grammatical variations thereof, means the decomposition of an explosive substance that is propagated by a flame front that moves slowly through the explosive substance, at a subsonic rate (e.g., usually below 2,000 meters per second (m/s)). This type of decomposition is characteristic of a low explosive substance. As used herein, the term "detonate," and all grammatical variations thereof, means the decomposition of an explosive substance that is propagated by a shock wave that passes through the explosive substance at supersonic speeds (e.g., up to 9,000 m/s). This type of decomposition is characteristic of a high explosive substance. Some explosives are capable of deflagration and detonation. The Deflagration to Detonation Transition (DDT) refers to a phenomenon when a sudden transition takes place from a deflagration type of reaction to a detonation type of reaction. In other words, a subsonic flame and pressure front may accelerate to supersonic speed, transitioning from deflagration to detonation. As the explosive substance reacts, and the flame front in the explosive propagates, pressure and temperature increase within the initiator housing, increasing the stimulus to the explosive until the explosive substance transitions from the deflagration mode to the detonation mode. While the flame front propagation and the transition from deflagration to detonation occur rapidly in general purpose secondary explosives, in thermally stable secondary explosives, the transition from deflagration to detonation may occur relatively more slowly and over longer distances.

An initiator may be activated in response to external signals, including a pressure signal, an electrical signal, and/or another type of signal. For example, the initiator may be activated in response to a percussive impulse. The percussive impulse may be the result of impact from a firing pin. Another example is activation in response to an electrical current from a discharging electrical capacitor.

There are various types of initiators. Initiators can be non-electric, electric, or electronic. Examples of non-electric initiators include, but are not limited to, flame initiators, spark initiators, friction-initiated initiators, stab initiators, chemical initiators, optic initiators, and percussion initiators. Examples of electric initiators include, but are not limited to, exploding bridge wire initiators, slapper initiators (also known as an exploding foil initiator), and laser initiators.

An initiator generally includes an initiator housing, an explosive substance confined within the initiator housing, consisting of an ignition mix or first-fire mixture, and transition and base loadings. If the initiator is electric, the initiator often further contains a firing signal receptor for receiving a firing signal and conveying the firing signal to initiate the explosive substance. An initiator generally includes a first explosive substance, a second explosive substance, and optionally a third explosive substance. The first explosive substance can be located closest to an activator and is generally initiated first because it can be more sensitive to initiation compared to the second explosive substance. The heat and pressure from the initiated first explosive substance then initiates the second explosive substance, and so on, until the other components in the ballistic train such as a detonating cord and shaped charges are initiated.

Explosive substances can be categorized by their sensitivity to stimuli. Primary explosives are highly sensitive to stimuli such as impact, friction, heat, and/or electrostatic charges; whereas, secondary explosives are less sensitive to stimuli. Those skilled in the art often use the sensitivity of lead azide or lead styphnate explosive as a benchmark. Primary explosives may be identified as explosives that are equally, or more sensitive than, lead azide or lead styphnate, while secondary explosives may be identified as explosives that are less sensitive than lead azide or lead styphnate. Explosives may be additionally characterized by a variety of different parameters including sensitivity to impact, thermal stability, ability to dent a standard metal plate when detonated, crystal size, shape, and other parameters. For example, primary explosives are generally very sensitive to stimuli; thus, they can be initiated via a relatively small amount of heat, pressure, or other stimuli. Examples of primary explosives include: lead azide, lead styphnate, silver azide, and silver fulminate. By contrast, secondary explosives are far less sensitive to stimuli, thus making them more resistant to heat, pressure, or other stimuli.

There are tests that can be performed to help differentiate and classify primary and secondary explosives. For example, the United States Air Force publishes the Military Standard—Safety and Performance Tests for Qualification of Explosives (commonly called the "Mil Standard"). The Mil Standard provides several tests that can be used to help classify an explosive as primary or secondary. As used herein, a substance is considered to be a "secondary explosive" if the substance has a higher value compared to a control sample of normal lead styphnate or dextrinated lead azide according to at least one of the following tests: impact sensitivity, impact sensitivity small scale drop-weight test, and friction sensitivity.

The impact sensitivity test is performed according to Mil Standard Section 5.2.2 as follows. All samples, including the control sample, are tested in the loose, as prepared condition, after drying to constant weight at 65° C. (149° F.). Primary compositions with binders and solvents or with curing binders shall be dried, then ground in a ball mill using a dispersing fluid in which none of the ingredients including the binder are soluble, and finally heated to constant weight at 65° C. (149° F.). 35 milligrams (mg) (±1 mg) of each sample is placed on the rough side of a piece of No. 05 sandpaper which is supported on a steel anvil. The hardened steel striker is placed over the sample that is resting on the sandpaper and anvil. A 2.5 kilogram (kg) steel weight is dropped from a height of 50 centimeters (cm) in a frictionless guided drop so that it impacts the striker centrally. The response of the sample (i.e., a positive reaction via an explosion, burning, or other evidence of reaction or a negative reaction) is recorded. If the response is positive, then reduce the height the steel weight is dropped from in the next drop by 50%; and if the response is negative, then increase the height by 100%. Continue the drops until a region is found where a 50 trial Bruceton test can be run. A Bruceton analysis is one way of analyzing sensitivity and sensitiveness tests of explosives as described originally by Dixon and Mood in 1948. Also known as the "up and down test" or "the staircase method", a Bruceton analysis relies upon two parameters: first stimulus and step size. A stimulus is provided to the sample, and the results noted. If a positive result is noted, then the stimulus is decremented by the step size. If a negative result occurs, the stimulus is increased. The test continues with each sample tested at a stimulus 1 step up or down from the previous stimulus if the previous result was negative or positive. The results are tabulated and analyzed via Bruceton analysis, a simple computation of sums that can provide estimates of the mean and standard deviation of the results. Confidence estimates can also be produced. Accordingly, for this test, a secondary explosive has a mean height drop from the Bruceton test analysis that is greater than the control sample.

The impact sensitivity-small scale drop-weight test is performed according to Mil Standard Section 5.4.2 as follows. The sample size should be approximately 35 mg (+1 mg). Each sample should be a pellet not less than 6.35 mm (0.25 inch) in diameter and 0.635-0.254 mm (0.025-0.010 inch) thick. When testing non-curing explosives, this size pellet should be formed directly on a piece of sandpaper. The sample is placed on the rough side of a piece of No. 05 sand paper which is supported on a steel anvil. A hardened steel striker is placed over the sample on the sandpaper and anvil. A 2.5 kilogram steel weight is dropped from a height of 12 centimeters in a frictionless guided drop so that it impacts the striker centrally. Accordingly, for this test, a secondary explosive has a mean height drop that is greater than the control sample.

The friction sensitivity test is performed according to Mil Standard Section 5.4.8 as follows. The method of preparation of test samples depends upon the properties of the explosive and the intended procedure to be used in fabrication for use as a booster explosive. Pellets of the test explosive are fabricated via pressing, casting, molding, machining, isostatic pressing, extrusion, or by combination or other known methods. For granular explosives, four tenths (4/10) of a gram of the test explosive is pressed into the specimen holder at a pressure of 137,895.14 kPa. An abrasive strip consisting of spring steel strip 0.254 mm thick by 50.8 mm wide by 457.2 mm long, and hardened and tempered to a hardness of Rockwell C48/51 (Rockwell 30 N 66.5/69.5) is roughened on one side, over an area including the entire width and from one end to a point not less than 6.5 inches from the other end. The roughening is accomplished by means of a belt sander using a cloth belt with resin bonded, 60 grit silicon carbide abrasive (Carborundum, Locking, Type 865F, or equivalent). While sanding, the long axis of the stainless steel strip shall be perpendicular to the motion of the sanding belt. The sanding shall continue until all temper color has been removed from the area defined above and the apparent texture of this area is uniform. Fresh sanding belts, which have not been used for other operations, shall be used and not more than five spring steel straps shall be roughened with the same belt. The roughness shall be such as to have an average deviation of not less than 1.27 micrometers (μm) nor more than 2.286 picometers (pm), as measured by means of a profilometer, from the mean surface. A witness block is located with the help of spacer block such that witness block is approximately centered with center line of a specimen support bushing. The opposite side of the roughened side of the spring steel abrasive strip is coated with a two to one (2:1) mixture of S.A.E. 30W engine oil and flake graphite (Dixon Crucible Co. No. 635 or equivalent). The roughened side should be kept clean. The spring steel abrasive strip is installed with the roughened surface facing the specimen support bushing, and the end of spring steel strip (opposite end to that roughened) is bent around the heel of a jerk lever. The abrasive strip is clamped to the blocks. The sample is placed in a holder assembly and the holder assembly is inserted in the support bushing via the application of normal force of 759.78±11.34 kg (1,675±25 pounds) to the ram of the holder assembly. Either hydraulic pressure or dead weight may be used to apply and maintain the normal force. The "boom box" is closed, the safety bar is removed, the handle of the pendulum adjusted so that its center of gravity is 45.72±1.27 cm above its low equilibrium point (at which it strikes the jerk lever), and the pendulum is released. If the apparatus is performing normally, the spring steel abrasive strip will be jerked entirely free from the boom box (except for pieces which may be broken or torn from the strip as the result of an explosion). The pendulum is returned to its top position, the safety bar replaced the boom box opened, the normal force removed, and the holder assembly removed from the support busing. Any reaction which results in an expansion of 0.127 mm or more of the holder assembly or produces a dent more than 0.0508 mm deep in the witness block, or both, is considered to be an explosion. Accordingly, for this test, a secondary explosive would have significantly larger values when compared to data values from a control sample.

Within the class of secondary explosives is a sub-class of thermally-stable secondary explosives. Thermally-stable secondary explosives are generally stable at a temperature of at least 400° F. (204.4° C.). Included in this family are explosives such as: 2,6-Bis(picrylamino)-3,5-dinitropyridine "PYX"; (1,3,5-trinitro-2,4,6-tripicrylbenzene) "BRX"; and (2,2',2"-4,4',4"-6,6',6"-nonanitro-m-terphenyl) "NONA." Some thermally-stable secondary explosives may exhibit thermal stability at temperatures greater than 400° F. (204.4° C.) and times of greater than 30 min. For example, a secondary explosive can be stable at temperatures greater than 425° F. (218.3° C.), and even greater than 450° F. (232.2° C.) for over 100 hours. Thermally-stable explosives refer to explosives that are characterized by minimal decomposition (which may be estimated by gas evolution) caused by exposure to elevated temperatures for extended periods of time. The thermal stability of such an explosive may be tested in a laboratory using an oven set at a selected temperature. The explosive is placed in the oven and at certain time points a portion of the explosive may be analyzed for any decomposition (usually by volume of evolved gas or weight loss of the sample). For use in downhole applications, suitable thermally-stable explosives are those that are stable at the downhole temperatures (typically, 200° C. or higher) for a duration of the intended operations, e.g., several hours, days, weeks, or even longer.

Explosives can be in a variety of forms, including liquids, gels, plastics, or powders. Explosive powders may be compressed to form dense pellets and/or shaped explosive charges. Explosives may also include non-chemically reactive, non-explosive materials, for example, sawdust and waxes as binders. These additional non-explosive materials may contribute to stabilizing an otherwise overly sensitive explosive. Conversely, other non-explosive materials may contribute to increasing the sensitivity of an insensitive explosive, and are commonly referred to as a sensitizer. These substances are sometimes chemically reactive. Examples of sensitizers include energetic salts, energetic binders or plasticizers, and thermobaric mixtures.

Because primary explosives are easier to initiate compared to secondary explosives, the use of primary explosives in higher temperature and higher pressure environments causes their use to pose potential safety concerns. The use, however, of secondary explosives in these types of environments helps to ensure that the explosive substance does not prematurely initiate, thus causing potential harm to workers and equipment. However, the insensitivity of secondary explosives has resulted in problems with initiation of the explosives at the desired time. Industry experts have addressed issues with the insensitivity of secondary explosives by reprocessing the explosives, including thermally-stable secondary explosives like PYX, to make them more sensitive to initiation. This reprocessing alters the properties of the explosives so that they become more like primary explosives and have the associated issues with increased sensitivity and safety concerns. Another way that insensitivity problems have been addressed is to add a small amount of a primary explosive to the secondary explosive to increase the likelihood of initiation of the secondary explosive. The addition of a primary explosive or the use of primary explosives only, in initiators can also result in greater safety and reliability concerns.

Therefore, there is a need for an initiator comprised of a secondary explosive substance that is still being capable of being initiated without the addition of a primary explosive. It has been discovered that the use of an initiator comprised solely of one or more secondary explosives can be used to accomplish these goals.

According to an embodiment, an initiator comprises: a first explosive substance, wherein the first explosive substance comprises a secondary explosive, wherein at least the first explosive substance is capable of being initiated, and wherein the explosive substances of the initiator contain effectively no primary explosive.

According to another embodiment, an initiator comprises: a first explosive substance, wherein the first explosive substance comprises a secondary explosive, wherein at least the first explosive substance is capable of being initiated, and wherein the initiator comprises effectively no primary explosive.

According to another embodiment, a method of using an initiator comprises: initiating an initiator, wherein the initiator comprises: a first explosive substance, wherein the first explosive substance comprises a secondary explosive, wherein at least the first explosive substance is capable of being initiated, and wherein the explosive substances of the initiator contain effectively no primary explosive.

Any discussion of the embodiments regarding the initiator is intended to apply to all of the apparatus and method embodiments. Any discussion of a particular component of an embodiment (e.g. an explosive substance or a sensitizer) is meant to include the singular form of the component and also the plural form of the component, without the need to continually refer to the component in the singular and plural form throughout. For example, if the discussion involves "the explosive substance," it is to be understood that the discussion pertains to one explosive substance (singular) and two or more explosive substances (plural).

Turning to the figures, FIG. 1 depicts a well system 10 containing an initiator 100 located within a wellbore 11. The well system 10 can also include more than one wellbore 11. The wellbore 11 can penetrate a subterranean formation 20. The subterranean formation 20 can be a portion of a reservoir or adjacent to a reservoir. The wellbore 11 can have a generally vertical cased or uncased section (not shown) extending downwardly from a casing 15, as well as a generally horizontal cased or uncased section extending through the subterranean formation 20. The wellbore 11 can include only a generally vertical wellbore section or can include only a generally horizontal wellbore section.

A tubing string 24 (such as a stimulation tubing string or coiled tubing) can be installed in the wellbore 11. The well system 10 can comprise multiple zones (not shown). More than one initiator 100 can be positioned in the well. The zones can be isolated from one another in a variety of ways known to those skilled in the art. For example, the zones can be isolated via multiple packers. The packers can seal off an annulus located between the outside of the tubing string 24 and the wall of wellbore 11.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 26 to isolate different zones. Cement may also be used in addition to packers 26.

The initiator 100 can be used in a variety of industries. For example, the initiator 100 can be used in the construction industry, mining industry, military applications, demolition, or oil and gas industry. According to an embodiment, the initiator 100 is used in a high-temperature or high-pressure well. According to another embodiment, the well has a bottomhole temperature of at least 200° F. (93° C.), preferably having a temperature in the range of about 200° F. to about 700° F. (about 93° C. to about 371° C.). As used herein, the term "bottomhole" means the location of the well where the initiator is to be used. While the initiator 100 taught by the present disclosure may be operated in some high temperature, high pressure applications where other initiators may not be suitable, the initiator 100 of the present disclosure may also be used successfully in lower temperature, lower pressure environments.

In a preferred embodiment, the initiator 100 comprises effectively no primary explosive. The explosive substances of the initiator are also disclosed to contain effectively no primary explosive. The phrase "effectively no primary explosive" is included to provide for the possibility that some minute and unintentional quantities of primary explosives may be found in the secondary explosive substances making up the initiator. Such trace amounts of primary explosives may unintentionally infiltrate the secondary explosives by a variety of circumstances. However the trace amounts that may be present should not be so great as to render the secondary explosive to be classified as a primary explosive.

Figure 2:
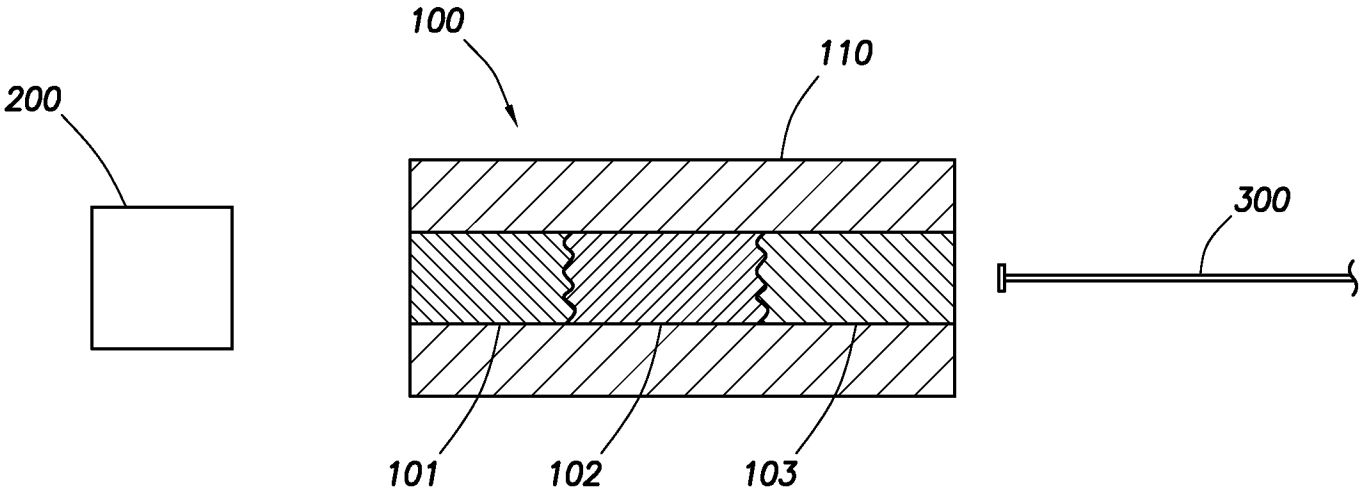
FIG. 2 depicts the initiator.

As can be seen in FIG. 2, the initiator 100 includes a first explosive substance 101. The first explosive substance can be an ignition mix. The initiator 100 can further include a second explosive substance 102, wherein the second explosive substance comprises a secondary explosive. The initiator 100 can further comprise a third explosive substance 103, a fourth explosive substance (not shown), and so on, wherein each of the explosive substances comprise a secondary explosive. Preferably, all of the explosive substances of the initiator (i.e., the first, second, third, etc. explosive substances 101, 102, and 103) are capable of being initiated. According to an embodiment, the explosive substances of the initiator 100 are stable. Therefore, the first, second, third and so on explosive substances 101, 102, and 103 are stable. According to another embodiment, the explosive substance is a thermally-stable secondary explosive. According to yet another embodiment, all of the explosive substances of the initiator 100 are thermally-stable secondary explosives.

The following discussion applies to the secondary explosive for all of the explosive substances (i.e., the first, second, third, etc. explosive substances 101, 102, and 103). The secondary explosive can be selected from the group consisting of: 2,6-Bis(picrylamino)-3,5-dinitropyridine "PYX"; (1,3,5-trinitro-2,4,6-tripicrylbenzene) "BRX"; (2,2',2"-4,4',4"-6,6',6"-nonanitro-m-terphenyl) "NONA"; HNS-1 (wherein HNS is generally hexanitrostilbene); HNS-II; HNS-IV; 2,4,6,8,10,12-hexanitro-2,4,6,8,10,12-hexaazaisowurtzitane (HNIW) "CL-20"; N,N'-bis(1,2,4-triazol-3-yl)-4,4'-diamino-2,2',3,3',5,5',6,6'-octanitroazobenzene "BTDAONAB", tetranitrobenzotriazolo-benzotriazole "Tacot"; dodecanitro-m,m'-quatraphenyl "DODECA"; and combinations thereof.

The secondary explosive can be in particle form. The particles can be geometric in shape. For example, the particles can be triangular, rectangular, pyramidal, cubic, needle-like, or spherical in shape. According to an embodiment, the particles are in a crystalline form. The particles can be selected from the group consisting of bulk particles, mesoscopic particles, or nanoparticles. As used herein, a "bulk particle" is a particle having a particle size of greater than 1 micrometer (1 μm or 1 micron). As used herein, a "mesoscopic particle" is a particle having a particle size in the range of 1 micron to 0.1 micron. As used herein, a "nanoparticle" is a particle having a particle size of less than 0.1 micron. As used herein, the term "particle size" refers to the volume surface mean diameter ("$D_s$"), which is related to the specific surface area of the particle. The volume surface mean diameter may be defined by the following equation: $D_s=6/(\Phi_s A_w \rho_p)$, where $\Phi_s$=sphericity; $A_w$=specific surface area; and $\rho_p$=particle density. According to an embodiment, the shape and particle size of the secondary explosive is selected such that the secondary explosive has a desired surface area. The desired surface area can be a sufficient area such that the explosive substance is capable of being initiated.

At least the first explosive substance 101 is capable of being initiated. The second 102, third 103, and so on explosive substances can also be capable of being initiated. According to an embodiment, all of the explosive substances are capable of being initiated. The methods include the step of initiating the initiator 100. The initiation of the initiator 100 can include initiating at least the first explosive substance 101. The initiation can also include the initiation of all of the explosive substances of the initiator 100. The explosive substance can be initiated via an activator 200. The activator 200 can be capable of producing an external signal to at least the first explosive substance 101. The external signal can be any signal that is sufficient to cause initiation of at least the first explosive substance 101. By way of example, the external signal can be a pressure signal, an electrical signal, and/or another type of signal. The initiator 100 can be activated in response to a percussive impulse, for example, an impact from a firing pin. As an alternative example, the initiator 100 can be activated in response to an electrical current, for example, but not by way of limitation, in response to a surge of current from a discharging electrical capacitor. In an embodiment, the initiator 100 can comprise one of a semiconductor bridge (SCB), a primer, and a percussion cap. The activator 200 can be selected from the group consisting of, a firing pin, an exploding bridge wire, slappers, lasers, sparks, friction-initiated devices, stab devices, chemical devices, optic devices, and percussion devices. The initiator 100 can be non-electric, electric, or electronic. According to an embodiment, the initiator 100 is non-electric. Examples of non-electric initiators include, but are not limited to, flame initiators, spark initiators, friction-initiated initiators, stab initiators, chemical initiators, optic initiators, and percussion initiators.

According to an embodiment, the initiation of the first explosive substance 101 causes deflagration of the first explosive substance. According to another embodiment, the initiation of the first explosive substance 101 causes detonation of the first explosive substance. According to yet another embodiment, the initiation of the first explosive substance 101 causes deflagration and detonation. For example, the first explosive substance 101 can experience a Deflagration to Detonation Transition (DDT), wherein a subsonic flame may accelerate to supersonic speed, transitioning from deflagration to detonation.

According to an embodiment, the initiation of the first explosive substance 101 causes the second explosive substance 102 to initiate. According to another embodiment, the initiation of the second explosive substance 102 causes the third explosive substance 103 to initiate. The methods can further comprise the step of positioning the initiator 100 adjacent to a detonation cord 300. According to an embodiment, the initiation of the first explosive substance 101 is capable of causing initiation of the detonation cord 300. As can be seen in FIG. 2, the first explosive substance 101 can be positioned adjacent to the activator 200, the second explosive substance 102 can be positioned adjacent to the first explosive substance 101, and the third explosive substance 103 can be positioned adjacent to the second explosive substance 102. In this manner, the activator 200 can initiate the first explosive substance 101, which in turn can initiate the second explosive substance 102, which can in turn initiate the third explosive substance 103, which can in turn initiate the detonation cord 300. Of course, there can only be one explosive substance or more than three explosive substances. Preferably, at least one of the explosive substances is capable of initiating the detonation cord.

The methods can further comprise the step of detonating a charge, wherein the step of detonating is performed after the step of initiating the initiator. The charge can be capable of being detonated via initiation of the detonation cord 300. The charge can be a shaped charge. According to an embodiment, the charge is located in a wellbore 11. The methods can further comprise the step of positioning the charge in the wellbore 11. The charge can be located within a perforating gun 400 and the step of positioning can include introducing the perforating gun 400 into the wellbore 11. The perforating gun 400 can also contain more than one charge. According to an embodiment, the initiation of the detonation cord 300 causes the detonation of more than one charge. According to another embodiment, the detonation of the charge creates a perforation tunnel.

A secondary explosive is generally insensitive to initiation. According to an embodiment, the size and shape of the particles of the secondary explosive are selected such that the explosive substance is capable of being initiated or is initiated. By way of example, the shape of the particles can be needle-like wherein the particles are more susceptible to friction. The friction created between the particles can create a temperature greater than the stability temperature of the explosive substance, such that the explosive substance is initiated. By way of another example, the size of the particles can be reduced; whereby a greater surface area of the particles exists. In this manner, there is more surface area of the particles that enables the particles to come in contact with each other. The more contact between the particles, the more friction and resulting heat can be produced.

The concentration of the secondary explosive can also be selected such that the first explosive substance 101, and preferably all of the explosive substances of the initiator 100, are capable of being initiated or are initiated. The concentration may vary depending on the size and shape of the particles. For example, if the particles are relatively large or the shape is not sufficient to enable the particles to come in contact with each other, then the concentration of the secondary explosive may need to be increased.

In order to increase the sensitivity of the secondary explosive, any of the explosive substances 101, 102, and 103 can further comprise a sensitizer. The sensitizer can be any material that is capable of increasing the sensitivity of the secondary explosive compared to a secondary explosive without the sensitizer. The sensitizer can be selected from the group consisting of energetic salts, energetic binders or plasticizers, micro silica materials, thermobaric mixtures, and combinations thereof in any proportion. As used herein, the term "energetic" means capable of imparting energy, preferably in the form of heat, to a nearby substance. The energetic salt can be selected from the group consisting of diazonium salts ($R—N_2^+$), bromate salts ($BrO_3^-$), chlorate salts ($ClO_3^-$), chlorite salts ($ClO_2^-$), perchlorate salts ($ClO_4^-$), picrate salts (2,4,6-trinitrophenoxide), picramate salts (2-amino-4,6-dinitrophenoxide), hypohalite salts ($XO^-$), and iodate salts ($IO_3^-$), and combinations thereof. The energetic binder or plasticizer can be selected from the group consisting of: (3-nitratomethyl-3-ethyl oxetane) "polyNIMMO"; (1,1-[methylenebis(oxy)]-bis-[2-fluoro-2,2-dinitroethane]) "FEFO"; polyglycidyl nitrate "PGN"; and combinations thereof. The thermobaric mixture can include a metal or metal alloy, usually aluminum, and a nitramine or other oxidizer.

According to an embodiment, the sensitizer is in particle form. The particles of the sensitizer can be selected from the group consisting of bulk particles, mesoscopic particles, or nanoparticles. According to an embodiment, the particle size of the sensitizer is selected such that at least the first explosive substance 101 is capable of being initiated or is initiated. If the second explosive substance 102 and/or the third explosive substance 103 also include a sensitizer, then preferably, the particle size of the sensitizer is selected such that the second and/or third explosive substance 102 and/or 103 is capable of being initiated or is initiated. The size and shape of the sensitizer can be selected such that depending on the size, shape, and concentration of the secondary explosive, the explosive substance 101, 102, or 103 is capable of being initiated or is initiated.

The concentration of the sensitizer can be selected such that the first explosive substance 101, and preferably all of the explosive substances of the initiator 100, are capable of being initiated or is initiated. The concentration of the sensitizer may vary depending on the size and shape of sensitizer particles. According to an embodiment, the sensitizer is in a concentration of at least 1% by weight of the explosive substance (i.e., the first, second, third, etc. explosive substances 101, 102, and 103). The sensitizer can also be in a concentration in the range of about 1% to about 50%, preferably, about 1% to about 10% by weight of the explosive substance.

According to an embodiment, the secondary explosive initiates via an increase in temperature. The increase in temperature is preferably, a temperature greater than the stability temperature (i.e., the temperature at which the explosive can initiate) of the secondary explosive. The increase in temperature can be a result of friction between the particles of the secondary explosive. The sensitizer can also create the increase in temperature in the explosive substance, commonly called a hot spot. The increased temperature can cause initiation of at least the first explosive substance 101. This embodiment can be useful when it is not feasible to create an increase in temperature via friction between the secondary explosive particles. According to an embodiment, the sensitizer does not render the secondary explosive a primary explosive. Therefore, the exact sensitizer used, the shape and size of the particles, and the concentration of the sensitizer should be selected such that the explosive substance can be initiated, but that the initiator as a whole is stable.

The initiator 100 can further comprise a housing 110. The housing 110 can have a shape that is capable of containing the first, second, third, etc. explosive substances 101, 102, and 103. The housing 110 can comprise a metal, metal alloy, thermoplastic, or combinations thereof. According to an embodiment, at least the first explosive substance 101 is contained within the housing 110. The housing 110 can be tubular, rectangular, square, or pyramidal in shape. According to an embodiment, the housing 110 is capable of withstanding temperatures above 400° F. (204.4° C.) for a time of at least 60 minutes (min). According to another embodiment, the housing 110 is capable of withstanding a pressure up to 30,000 psi (206.8 MPa) for a time of at least 30 min. As used herein, the term "withstanding" means the material does not melt, crack, or become damaged to such a degree that the material is no longer capable of containing the explosive substances. In some instances, the housing 110 may need to be capable of containing the explosive substance for the length of time necessary for the substance to undergo a Deflagration to Detonation Transition (DDT). For example, in some embodiments, the housing 110 is capable of withstanding a pressure and temperature increase within the housing 110, which increases the stimulus to the explosive substance until the explosive substance transitions from the deflagration mode to the detonation mode.

The housing 110 can include an abrasive material on the inside wall of the housing. The abrasive material can create friction between the wall of the housing and the particles of the secondary explosive and/or the sensitizer. In this manner, movement of the particles against the inside wall of the housing 110 can create friction, thus increasing the temperature of the secondary explosive.

The first explosive substance 101, and any of the explosive substances, can be a variety of shapes. The shape of the explosive substance can be tubular, rectangular, square, or pyramidal in shape. The shape of the explosive substance can be selected based on the shape of the housing 110.

The explosive substance may also comprise percentages of other non-explosive materials, for example, sawdust, powdered silica, diatomaceous earth, plastics, polymers, and waxes. The additional non-explosive materials may bind an explosive compound and promote ease of shaping a quantity of the explosive. The binder can be used to help form the explosive substance into a desired shape and retain the desired shape prior to initiation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An initiator comprising:

a first explosive substance, wherein the first explosive substance comprises a secondary explosive, wherein at least the first explosive substance is capable of being initiated, wherein the secondary explosive comprises needle-shaped crystalline particles of 2,6-Bis(picrylamino)-3,5-dinitropyridine, wherein the initiator does not comprise a primary explosive as classified under the Military Standard—Safety and Performance Tests for Qualification of Explosives as published by the United States Air Force, wherein the initiator is a non-electric initiator, and wherein the initiator comprises a housing containing an abrasive material on the inside of the housing; wherein the first explosive substance further comprises an energetic salt selected from the group consisting of diazonium salts, bromate salts, chlorate salts, chlorite salts, perchlorate salts, picrate salts, picramate salts, hypohalite salts, iodate salts, and any combinations thereof; wherein the first explosive substance further comprises an energetic binder selected from the group consisting of: (3-nitratomethyl-3-ethyl oxetane); (1,1-[methylenebis(oxy)]-bis-[2-fluoro-2,2-dinitroethane]); polyglycidyl nitrate; and combinations thereof; wherein the first explosive substance further comprises a thermobaric mixture consisting of a metal or metal allow and an oxidizer.

2. The initiator according to claim 1, wherein the initiator is used in a well having a bottomhole temperature of at least 200° F.

3. The initiator according to claim 1, wherein the first explosive substance is an ignition mix.

4. The initiator according to claim 1, wherein the first explosive substance is initiated via an activator.

5. The initiator according to claim 4, wherein the activator is selected from the group consisting of, a firing pin, an exploding bridge wire, slappers, lasers, sparks, friction-initiated devices, stab devices, chemical devices, optic devices, and percussion devices.

6. The initiator according to claim 1, wherein the initiator further comprises a second explosive substance, wherein the second explosive substance comprises a secondary explosive.

7. The initiator according to claim 6, wherein initiation of the first explosive substance causes the second explosive substance to initiate.

8. The initiator according to claim 1, wherein initiation of the first explosive substance causes deflagration of the first explosive substance.

9. The initiator according to claim 1, wherein initiation of the first explosive substance causes detonation of the first explosive substance.

10. The initiator according to claim 1, wherein initiation of the first explosive substance causes deflagration and detonation of the first explosive substance.

11. The initiator according to claim 1, wherein the secondary explosive initiates via an increase in temperature.

12. The initiator according to claim 11, wherein the increase in temperature is a result of friction and/or compression of a pore space between the needle-shaped crystalline particles of the secondary explosive.

13. The initiator according to claim 1, wherein the needle-shaped particles are sized such that the first explosive substance is initiated.

14. The initiator according to claim 1, wherein a concentration of the secondary explosive is selected such that the first explosive substance is initiated.

15. The initiator according to claim 1, wherein the first explosive substance further comprises a sensitizer.

16. The initiator according to claim 15, wherein the sensitizer includes micro silica materials.

17. A method of using an initiator comprising:

initiating an initiator, wherein the initiator comprises:

a first explosive substance, wherein the first explosive substance comprises a secondary explosive, wherein the secondary explosive comprises needle-shaped crystalline particles of 2,6-Bis(picrylamino)-3,5-dinitropyridine, wherein at least the first explosive substance is capable of being initiated, wherein the initiator does not comprise a primary explosive as classified under the Military Standard—Safety and Performance Tests for Qualification of Explosives as published by the United States Air Force, wherein the initiator is a non-electric initiator, and wherein the initiator comprises a housing containing an abrasive material on the inside of the housing; wherein the first explosive substance further comprises an energetic salt selected from the group consisting of diazonium salts, bromate salts, chlorate salts, chlorite salts, perchlorate salts, picrate salts, picramate salts, hypohalite salts, iodate salts, and any combinations thereof; wherein the first explosive substance further comprises an energetic binder selected from the group consisting of: (3-nitratomethyl-3-ethyl oxetane); (1,1-[methylenebis(oxy)]-bis-[2-fluoro-2,2-dinitroethane]); polyglycidyl nitrate, and combinations thereof; wherein the first explosive substance further comprises a thermobaric mixtures selected from the group consisting of a metal or metal alloy and an oxidizer.

18. The method according to claim 17, further comprising detonating a charge, wherein the detonating is performed after initiating the initiator.

19. The method according to claim 18, wherein the charge is a shaped charge.

20. The initiator according to claim 6, wherein the second explosive substance comprises a secondary explosive selected from the group consisting of: 2,6-Bis(picrylamino)-3,5-dinitropyridine "PYX"; (1,3,5-trinitro-2,4,6-tripicrylbenzene) "BRX"; (2,2',2"-4,4',4"-6,6',6"-nonanitro-m-terphenyl) "NONA"; HNS-1 (wherein HNS is generally hexanitrostilbene); HNS-IV; 2,4,6,8,10,12-hexanitro-2,4,6,8,10,12-hexaazaisowurtzitane (HNIW) "CL-20"; N,N'-bis(1,2,4-triazol-3-yl)-4,4'-diamino-2,2',3,3',5,5',6,6'-oc-tanitroazobenzene "BTDAONAB", tetranitrobenzotriazolobenzotriazole "Tacot"; dodecanitro-m,m'-quatraphenyl "DODECA"; and combinations thereof.

* * * * *